US005164562A

United States Patent [19]

Huffman et al.

[11] Patent Number: 5,164,562

[45] Date of Patent: Nov. 17, 1992

[54] COMPOSITE SUSCEPTOR PACKAGING MATERIAL

[75] Inventors: Todd H. Huffman, Roanoke, Va.; Christopher J. Parks, Ellicott City, Md.

[73] Assignee: Westvaco Corporation, New York, N.Y.

[21] Appl. No.: 388,483

[22] Filed: Aug. 2, 1989

[51] Int. Cl.[5] ..... H05B 6/80

[52] U.S. Cl. ..... 219/10.55 E; 219/10.55 F; 426/107; 426/234; 426/243; 99/DIG.14

[58] Field of Search ..... 219/10.55 E, 10.55 F; 426/107, 243, 113, 234, 241; 126/390; 99/251, DIG. 14; 428/34.2, 34.3, 34.8, 35.3, 35.8, 35.9; 229/35 MF, 903

[56] References Cited

U.S. PATENT DOCUMENTS

| | | | |
|---|---|---|---|
| 4,190,757 | 2/1980 | Turpin et al. | 219/10.55 E |
| 4,641,005 | 2/1987 | Seiferth | 219/10.55 E |
| 4,661,672 | 4/1987 | Nakanaga | 219/10.55 E |
| 4,703,148 | 10/1987 | Milkulski et al. | 219/10.55 E |
| 4,713,510 | 12/1987 | Quick et al. | 219/10.55 E |
| 4,775,771 | 10/1988 | Pawlowski et al. | 219/10.55 E |
| 4,777,053 | 10/1988 | Tobelmann et al. | 426/107 |
| 4,785,160 | 11/1988 | Hart | 219/10.55 E |
| 4,825,025 | 4/1989 | Seiferth | 219/10.55 E |
| 4,835,352 | 5/1989 | Sasaki et al. | 219/10.55 E |

*Primary Examiner*—Philip H. Leung

[57] ABSTRACT

A composite susceptor packaging material for use in a microwave oven is disclosed comprising at least two spaced susceptor layers in overlying relation. By using two susceptor layers, the amount of microwave energy reaching food products packaged in such material can be controlled while still heating the surface of the food product to a high enough temperature for surface browning. In this manner the inside of the food product remains moist without drying out. Also disclosed are typical packages prepared from the composite susceptor material.

9 Claims, 2 Drawing Sheets

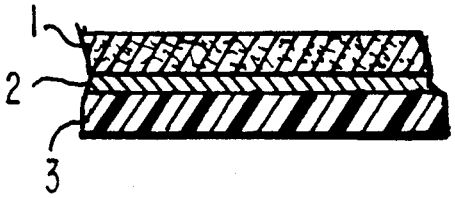
Fig 1. (PRIOR ART)
Fig 2.
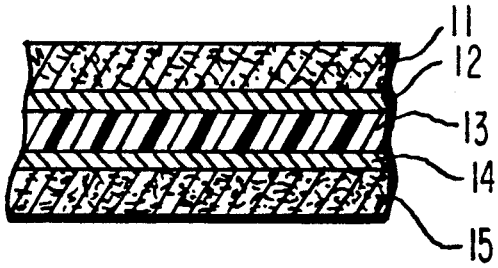
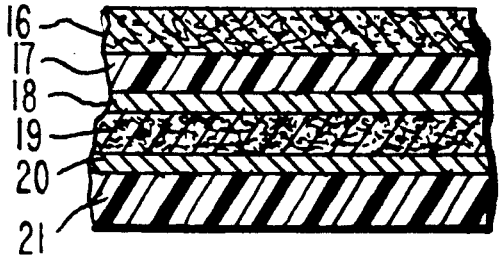
Fig 3.
Fig 6.
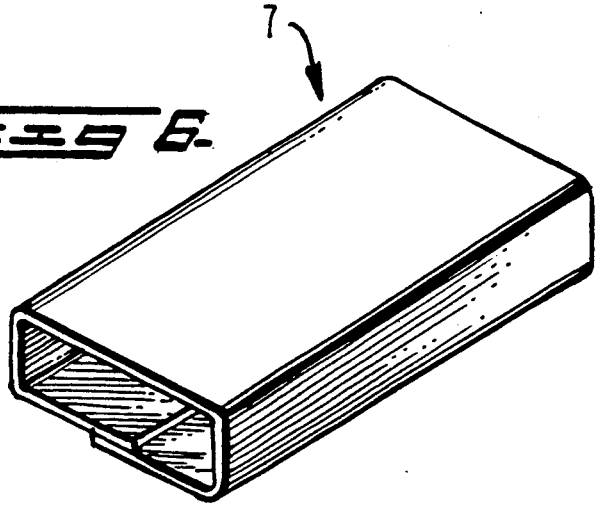

COMPOSITE SUSCEPTOR PACKAGING MATERIAL

BACKGROUND OF THE INVENTION

The present invention is directed to an improved composite susceptor material for use in the manufacture of disposable packages for cooking in microwave ovens. More specifically, the present invention comprises an improved composite structure including paperboard, which when incorporated into packages for heating food in a microwave oven, provides cooked food products with a desirable crisp outer surface and a cooked but moist interior. By incorporating at least two spaced susceptor layers in the composite structure in overlying relation, the susceptor layers provide both a shielding and a heating effect. Thus while the prior art discloses susceptor materials for use in the manufacture of packages for heating the surfaces of food products in a microwave oven, and package structures for shielding specific surfaces of food products while heating other surfaces, the present invention provides a single material with both advantages, namely, intense heating at the surface combined with shielding of the interior of the food products.

U.S. Pat. Nos. 4,641,005 and 4,825,025 each teach the construction of a single susceptor material for use in making disposable packages for use in a microwave oven. In each case, the susceptor material comprises a base layer of structural stock material (paperboard); a layer of electrically conductive susceptor material (elemental aluminum); and a protective support material (polyester) for supporting the susceptor material and for contacting the food product. Meanwhile U.S. Pat. Nos. 4,661,672; 4,703,148; and 4,777,053 each disclose packages for heating food in a microwave oven comprising spaced heating and shielding elements which serve both to heat the surface of the food while shielding portions of the food.

However, in accordance with the present invention, the use of a composite susceptor material with multiple susceptor layers in overlying relation, each having their own transmittance and reflectance characteristics, it is possible to control the total amount of energy absorbed for heating, and transmitted for direct cooking, with greater accuracy and more versatility than the prior art. For instance, all susceptors have measurable transmittance and reflectance characteristics. As an example, the absorbance of a single susceptor material having a transmittance of 20% and an reflectance of 20% is 60%. However, the transmittance of a composite susceptor material according to the present invention with two spaced susceptor layers of the same susceptor material is less than 5%, while the absorbed energy of the composite material is increased from 60% to over 75%. Obviously the total energy absorbed or transmitted by the composite susceptor material can be selectively controlled by choosing the susceptor layers having the desired transmittance and reflectance characteristics.

SUMMARY OF INVENTION

It is an object of the present invention to provide a composite susceptor material for use in packages for microwave ovens to brown and crisp foods with high moisture content such as breaded fish or the like, without drying out their interior.

It is another object of the present invention to provide a composite susceptor material useful in making packages with a minimum number of components and without the need for separate inserts or the like.

By employing two or more susceptor layers in overlying relation in a single composite susceptor material, the amount of microwave energy reaching the food product can be minimized while the amount of microwave energy absorbed by the susceptor is increased to heat the surface of the food to a high temperature. In this manner, the inside of the food product remains moist while the outside is crisped.

The primary advantage of the composite structure of the present invention is to decrease the amount of microwave energy transmitted to the food. This is especially important for high moisture foods such as breaded food products. The primary cooking objective for such food products is to heat the surface hot enough to crisp the breading while keeping the juices within the food product from escaping to the surface causing the breading to become soggy.

By incorporating the composite susceptor material into a disposable package, the cost of the package can be minimized and the convenience of use is enhanced.

One example of a composite susceptor material according to the present invention comprises essentially a base outer layer of structural stock material such as paperboard or the like, an interior layer comprising a film support containing metallized susceptor layers on both surfaces, and an inside, food contact layer comprising another layer of film or a grease-proof paper material. The use of a greaseproof paper material provides the added advantage of absorbing any food juices which migrate to the surface of the food product during the cooking process.

Another example of a composite susceptor material according to the present invention comprises an inner layer of structural stock material such as paperboard or the like having two outer layers of metallized film laminated to the paperboard with the metallized sides of the films adjacent to the paperboard. In this structure, the opposite surface of one of the metallized films serves as the product contact surface, and the opposite surface of the other metallized film is covered with paper or paperboard to provide a surface acceptable for printing. Other structures could obviously be devised with the understanding that the composite material always has at least two susceptor layers in overlying relation and spaced from one another by a film support material or paperboard. The minimum spacing of the susceptor layers is about one-half mil (0.0005 inch) or about the thickness of a typical sheet of film material.

Since one objective of the present invention is to shield the packaged food product from direct cooking by the microwave energy, it is important to substantially completely surround the food product in the food package. Examples of containers suitable for accomplishing this result include a two component package including a separate lid and tray, a single component package comprising a tray and integral lid, or a sleeve element, all prepared from the composite susceptor material. If the containers are formed or sealed with the application of heat, a suitable heat-sealable coating is required on all heat-sealable surfaces. Otherwise a suitable adhesive may be employed. In either case, it may be desirable to keep the susceptor layers from overlapping if hot spots in the package develope during heating.

BRIEF DESCRIPTION OF THE DRAWINGS

FIG. 1 is a cross-sectional elevation of a prior art susceptor material;

FIG. 2 is a cross-sectional elevation of a typical composite susceptor material for the present invention;

FIG. 3 is a cross-sectional elevation of a modified composite susceptor material for the present invention;

FIG. 6 is a perspective view of a sleeve structure formed from the composite susceptor material of the present invention.

DETAILED DESCRIPTION

Figure 4:
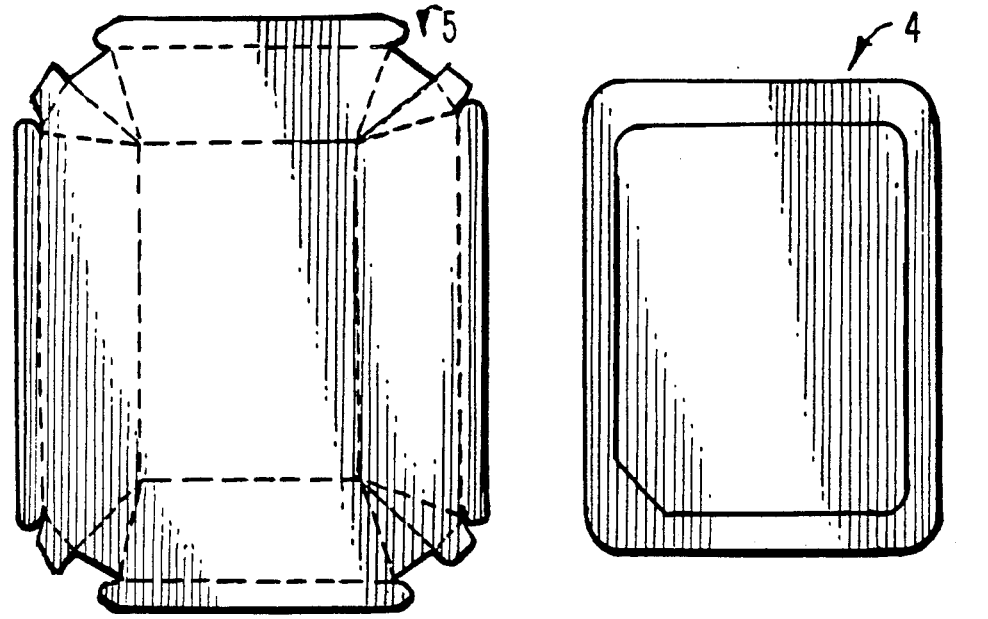
FIG. 4 is a plan view of typical blank structures for a two piece package comprising a separate tray and lid combination formed from the composite susceptor material of the present invention.

The existing commercial structure of a susceptor material for use in making packages for microwave ovens is shown in FIG. 1. This product comprises an outer base layer of structural stock material 1, for example paperboard, an intermediate layer of susceptor material 2, for example conductive elemental metal, and an inner protective layer 3 onto which the metal susceptor is deposited, for example a high heat tolerant food contact material such a polyester. This structure, when used to make food packages, provides a surface which is capable of being heating to a high temperature by microwave energy to brown the surface of food products in contact therewith. Unfortunately, there is no reliable way to control the temperature of the susceptor in the microwave oven other than by its exposure time, and often the food product becomes browned and burned on the outer surface, and also overcooked and dried out in the interior. In an effort to overcome this problem, and provide some control over the exterior/interior cooking effects of the microwave energy, the present invention was developed. By using two spaced susceptor layers in overlying relation in a single composite structure, the amount of energy received by the food product can be controlled while still heating the surface of the food product to a high enough temperature to brown the surface. At the same time, the interior of the food product gets cooked, but remains moist without drying out.

An example of a composite susceptor material according to the present invention is shown in FIG. 2. In this example, a single film support 13 is metallized on both sides using sputtering technology with susceptor material 12 and 14, and the metallized surface 12 is laminated to an outer paperboard layer 11, preferably clay coated paperboard, to give structural strength to the laminate and to provide a good outer surface for printing graphics or the like. Meanwhile, the other metallized surface 14 is laminated to an inner, food contact material 15 which could be film, paper or greaseproof paper. In at least one embodiment greaseproof paper is used for the inner food contact layer 15. The greaseproof paper provides a safe food contact surface and also serves to absorb some of the juices which escape from the food during the cooking process.

The laminating adhesive between the susceptor layers 12 and 14 and the outer paperboard layer 11 and the inner food contact layer 15 is preferably a water based adhesive examples of which are available from Swift Adhesives and National Starch Company. The susceptor layers 12, 14 comprise metals such as aluminum, stainless steel and inconel, having a resistivity in the range 100–2000 ohms per square, and the support film 13 for the susceptor layers 12, 14 is preferably a polymeric film, for example Dupont MYLAR film. The portion of the structure comprising the dual metallized film (metal-film-metal) is available from Deposition Technologies, 4540 Viewridge Avenue, San Diego, Calif. 92123. Meanwhile the greaseproof paper used for the inner food contact surface is available from manufacturers of such products known in the industry.

Another example of a composite susceptor material according to the present invention is shown in FIG. 3. This structure employs two separate metallized films 17 and 21 having layers of metal susceptor 18 and 20 applied thereto. These products could be prepared using known vacuum deposition technology. The metallized surfaces 18 and 20 of films 17 and 21 are laminated to opposite sides of a layer of structural stock material 19 such as uncoated paperboard using a typical water based adhesive substantially as described hereinbefore, and if desired, an outer layer of clay coated paperboard 16 may be laminated to the film support 17 to provide an outer surface for printing. If it is desired to have a heat sealable inner surface 21, a film support such as Dupont OL or ICI-850 may be substituted for Mylar film.

Figure 5:
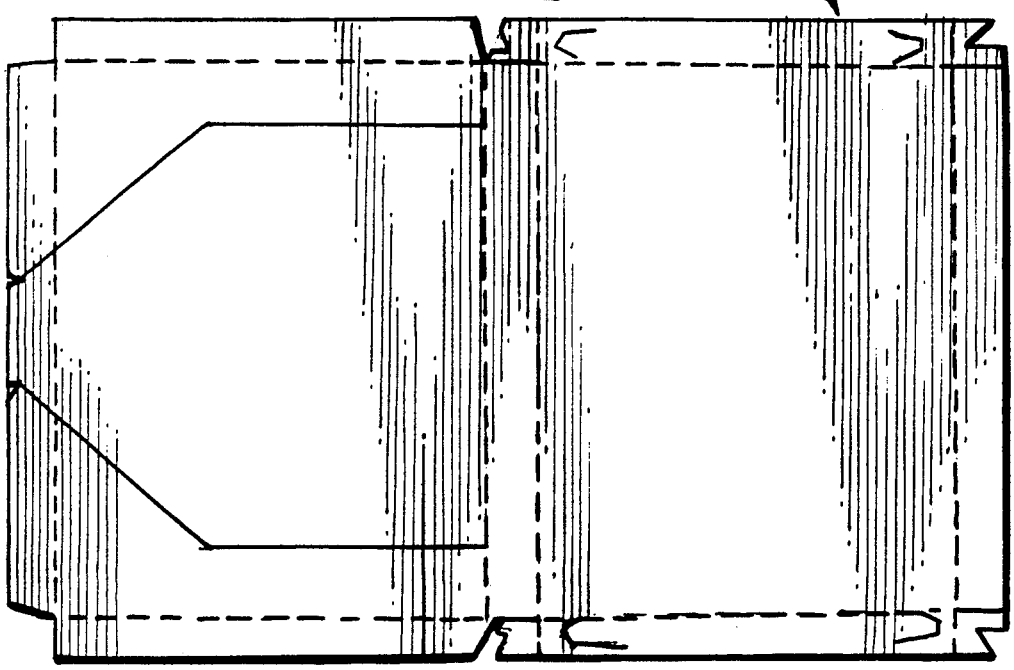
FIG. 5 is a plan view of a typical blank structure for a one piece container formed from the composite susceptor material of the present invention.

Both of the composite susceptor materials described above are designed for use in the construction of packages or sleeves for heating and cooking food in a microwave oven. Nevertheless, these structures could also be used to make inserts for existing packages if desired. Examples of packages that could be made with the composite materials herein are shown in FIGS. 4 and 5. FIG. 4 shows a typical two piece package comprising a separate lid 4 and tray 5, and FIG. 5 shows a typical one piece package 6 comprising an integral tray and lid. FIG. 6 illustrates an insert comprising a sleeve 7 that is wrapped around the food product for cooking. When used as an insert, the cost of the composite material of the present invention could be reduced since there would be no need to use coated paperboard for the outer surface to give good printability.

The present invention has been described hereinbefore in connection with known technology, i.e., with the use of metallized susceptor films, specifically vacuum metallized susceptor films and sputter metallized susceptor films. It should be noted however, that the susceptor layers could be applied either to the film supports or directly to the paperboard if desired using other technology, specifically by printing the susceptor material on these surfaces. An example of such a process is disclosed in European Patent Application EP 0276,654 and in pending U.S. patent application Ser. No. 07/327,514, filed Mar. 22, 1989, and assigned to the present assignee herein.

What is claimed is:

1. A composite laminate having inner and outer surfaces for use in the manufacture of disposable packages for microwave ovens and adapted to brown the surface of food products while leaving the interior of the food products moist when exposed to microwave energy, said composite laminate comprising:

(a) a primary layer of structural stock material comprising clay coated paperboard to provide structural rigidity and support for the physical shape of packages constructed from the composite laminate;

(b) an inner food contact layer adapted to directly contact the surface of food products packaged in packages constructed from the composite laminate; and, (c) a composite susceptor member located between said primary structural stock layer and said inner food contact layer, said composite susceptor member further comprising a single dielectric support layer having upper and lower surfaces with separate susceptor layers applied to each surface, means for adhering one of the susceptor layers to said primary structural stock layer and means for adhering the other susceptor layer to the inner food contact layer.

2. The laminate of claim 1, wherein the food contain layer is selected from the group consisting of paper, greaseproof paper and polymeric film.

3. The laminate of claim 2 wherein the dielectric support layer comprises a single layer of polymeric film.

4. A disposable food package for microwave ovens formed from a composite susceptor laminate adapted to brown the surface of food products packaged therein while leaving the interior of the food products moist when exposed to microwave energy said composite laminate comprising:

(a) a base layer of structural stock material comprising clay coated paperboard on the outer surface of said laminate to provide structural rigidity and support for the physical shape of the package constructed from said composite laminate;

(b) a food contact inner layer adapted to directly contact the surface of the food products packaged in said package; and, (c) a single support layer of polymeric film having susceptor layers applied to the opposed surfaces thereof located between said base layer and food contact layer and arranged so that the susceptor layers are adhesively bonded respectively to said base layer and said food contact layer.

5. The package of claim 4 wherein the two susceptor layers comprise layers of conductive, elemental metal bonded to said polymeric support layer.

6. The package of claim 5 wherein the food contact layer is selected from the group consisting of paper, greaseproof paper and polymeric film.

7. The package of claim 6 wherein the package structure comprises a sleeve which completely surrounds the food product.

8. The package of claim 6 wherein the package structure comprises a two piece container having a separate lid and tray for completely surrounding the food product.

9. The package of claim 6 wherein the package structure comprises a one piece container having an integral lid and tray for completely surrounding the food product.

* * * * *